US006372090B1

(12) United States Patent
Laapotti

(10) Patent No.: US 6,372,090 B1
(45) Date of Patent: Apr. 16, 2002

(54) METHOD AND APPARATUS FOR HANDLING PAPER OR CARDBOARD WEBS

(75) Inventor: Jorma Laapotti, Jyväskylä (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/366,944

(22) Filed: Aug. 4, 1999

Related U.S. Application Data

(60) Provisional application No. 60/095,331, filed on Aug. 4, 1998.

(51) Int. Cl.[7] ..... D21F 5/00; B05C 3/132

(52) U.S. Cl. ..... 162/206; 162/207; 162/290; 162/136; 162/359.3; 34/629; 34/463; 118/67

(58) Field of Search ..... 162/193, 204, 162/205, 206, 207, 265, 290, 306, 358.1, 358.3, 358.5, 359.1, 360.2, 360.3, 375, 135, 136; 34/60, 114, 117, 120, 623, 629, 459, 463; 118/58, 67, 68, 69, 641; 427/314, 359

(56) References Cited

U.S. PATENT DOCUMENTS

| | | | | | |
|---|---|---|---|---|---|
| 4,906,492 | A | * | 3/1990 | Groshens | 427/148 |
| 5,169,501 | A | | 12/1992 | Meinecke | 162/359.1 |
| 5,641,387 | A | * | 6/1997 | Baldini | 162/265 |
| 5,685,909 | A | * | 11/1997 | Reich et al. | 118/67 |
| 5,811,157 | A | * | 9/1998 | Kurtz et al. | 427/428 |
| 5,830,275 | A | * | 11/1998 | Reich | 118/641 |
| 5,865,955 | A | * | 2/1999 | Ilvespaa et al. | 162/207 |
| 6,051,068 | A | * | 4/2000 | Kohl et al. | 118/641 |
| 6,126,787 | A | * | 10/2000 | Elijoki et al. | 162/265 |

FOREIGN PATENT DOCUMENTS

| | | |
|---|---|---|
| WO | WO 93/23616 | 11/1993 |
| WO | WO 97/32080 | 9/1997 |
| WO | WO 98/27273 | 6/1998 |

* cited by examiner

*Primary Examiner*—Peter Chin
*Assistant Examiner*—Eric Hug
(74) *Attorney, Agent, or Firm*—Cohen, Pontani, Lieberman & Pavane

(57) ABSTRACT

A method and apparatus for producing paper or board, according to which the paper or board web is transferred continuously supported through a drying section of a paper or cardboard machine and both sides of the web are treated with a treating agent on a long nip applicator included with the drying section of the machine. The web is transferred from the last press nip of the press section to the first dryer of the dryer section with a continuous loop-like support member, for example, by a transfer belt, transfer felt or one of the press felts of the press section. The web is advantageously dried in the drying section with a blow unit on a porous drying felt by blowing hot air on the web with impingement dryers, and the drying felt may be cooled.

26 Claims, 3 Drawing Sheets

METHOD AND APPARATUS FOR HANDLING PAPER OR CARDBOARD WEBS

This application claim benefit to provisional application No. 60/095,331 filed Aug. 4, 1998.

FIELD OF THE INVENTION

The present invention relates to handling of paper or cardboard webs formed in a paper or cardboard machine, especially to leading the web during the subsequent handling process after the last nip of the press section of the machine.

BACKGROUND OF THE INVENTION

In a paper or board making machine, the web is formed by feeding a slurry of fibrous material from a head box onto a wire. Water is removed from the web on the wire at various pressing stages. At the beginning of the formation of the web, its strength is extremely low since the web contains only small amount of fibers compared to the amount of water. In the press section, the solids content of the web increases rapidly, but the web is still quite wet and its strength low. After the press section, the web is dried by different dryers using heat. The dried web is then normally treated in different processes to improve its properties according to a desired use of the web. The most common finishing processes are calendering, sizing and coating.

On the press section of the machine, the web is supported by a wire or felt, but in subsequent drying stages and during finishing, the web is guided by rolls or, in modern machines, also by belts, felts or wires. When the web is transferred forwards in the manufacturing process, it has to be supported on different surfaces, especially when the web is coated. The path of the web comprises usually several open draws wherein the web travels unsupported between two supporting members through open air. Since the web has to be tensioned to keep it on the supporting members and to compensate for the changes in web length and width during processing, a speed difference has to be set over the open draws on the supporting and driving members guiding the web. These open draws are necessary for a number of reasons. First, the shrinking, elongation and widening of the web has to be compensated as stated above. The largest dimensional changes of the web are caused by moisture content variations during processing and, if the variations are big, open draws are necessary since the dimensional changes cannot be compensated when the web is supported on a roll, belt or similar dimensionally rigid member. Second, it is difficult to remove a wet web from a support member and transfer it to a following member without special measures, since the web usually tends to follow the surface on which it is already attached to. It is often easier to remove the web from one support member and transfer it over an open draw to the next support member. Third, some of the apparatuses used for paper and cardboard making require that the web is led along a defined path through the process whereby it may be difficult to lead the web supportedly to the apparatus and from it. In some apparatuses, like roll calenders or coaters, the web cannot be supported continuously without changing the characteristic of the process. In calenders, the performance of the nip changes if, for example, a support belt is lead through the roll nips. In coating, the wet coated side of the web cannot be touched, whereby the web has to be supported on the dry side of the web, and there has to be an open draw between successive support members. The length of the open draw is determined by diameters of the rolls guiding the support member.

Even though the open draws are often necessary, they cause several problems. After the web is formed in the press section, it is still very wet and breaks easily. When such a web is taken over an open draw, the speed differences of the web transferring elements are supposed to keep the web on a predetermined tension so that no slacking or wrinkling of the web occurs. However, the speeds of the wires, rolls, belts and other elements transferring the web may vary slightly, whereby the tensions over the open draws changes. The tensile strength of the web may also vary, for example, because of variations in the moisture content. Further, there may be defects in the web. These and other factors may lead to a situation where the tension of the web exceeds the strength of the web, first usually on a limited area of the web, whereby the web breaks. Web breaks are the main reason for production stops.

One of the factors that influence heavily on the quality of the product and production costs in paper and board manufacture is drying of the web. As stated above, a web is first formed by a head box, wire and press section into a reasonably solid web, and the web is then dried to a desired moisture content, which is about 2% to 4% of the weight of the web. If the web is calendered, it has to be wetted thereafter to a higher moisture content depending on the calender type, and if the web is coated or sized, the web absorbs water from the coating or sizing mixture. The water added to the web on calendering evaporates normally during the calendering process, but the water absorbed in the web during coating or sizing has to be dried. The drying process requires a lot of energy and the dryers are quite costly and especially on fast machines very long drying sections have to be used, whereby the drying of the web after formation and during finishing forms a notable part of the manufacture costs and the cost of the machine.

One possibility to decrease the investment costs of the drying and dryers on a paper or board manufacturing machine is to combine coating and sizing with the drying of the web on an on-line manufacturing line so that the treating agent is spread on the web in the drying section of the manufacturing line. The problems of this solution are the mechanical stresses imposed on a wet web on application of the treating agent and increased moisture of the wet web that requires efficient drying process.

SUMMARY OF THE INVENTION

According to the present invention the web is transferred continuously supported through a drying section of a paper or cardboard machine, and both sides of the web are treated with a treating agent on a long nip applicator included to the drying section of the machine.

According to other aspects of the present invention, the web is transferred from the last press nip of the press section to the first dryer of the dryer section with a continuous loop-like support member, for example, by a transfer belt, transfer felt or one of the press felts of the press section.

The web is advantageously dried in the drying section with a blow unit on a porous drying felt by blowing hot air on the web with impingement dryers and the drying felt may be cooled.

Other objects and features of the invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

In the following, the term "treating agent" refers to a substance that is used for treatment of paper or cardboard web and contains water that makes the agent spreadable on the surface of the web. An "extended nip" is a nip having a greater length than a normal nip between two rolls, normally minimum length of an extended nip is considered to be about 50 mm.

Figure 1:
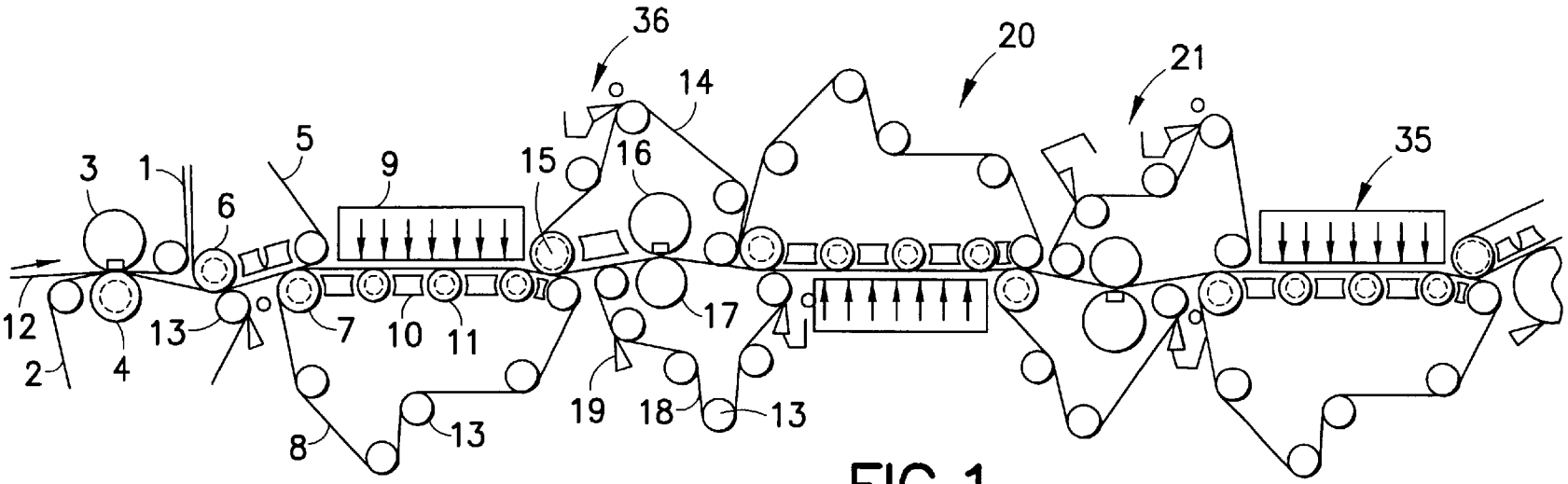
FIG. 1 shows diagrammatically one embodiment of the invention.

In the apparatus shown in FIG. 1, the web 12 enters the last pressing nip of the press section of a paper or cardboard machine on a felt 1. The press nip is formed between a press shoe 3 and a backing roll 4. A transfer belt 2 is arranged to run through the nip 3,4 guided by guide rolls 13. On the last pressing nip, water is removed from the web, and the web 12 is transferred to the surface of the transfer belt 2. Downstream of the transfer belt 2 is arranged a transfer felt 5 that is pressed on transfer belt 2 with a suction roll 6. The felt 5 is air-permeable, and the negative pressure produced by the suction roll attaches the web 12 to the felt 5. The transfer felt 6 transfers the web to a drying felt 8, that is pressed on the transfer felt 5 by a second suction roll 7 and the web 12 is transferred on the drying felt 8. The drying felt 8 is arranged to run linearly over rolls 11 and blow boxes 10 that support the drying felt 8. The blow boxes 10 may be of suction/blow design wherein the air blown towards the felt 8 is sucked back on the box with the moisture removed from the web 12. The rolls may be vacuum rolls or coated rolls, for example. On the web side of the drying felt is an impingement dryer unit 9 that blows hot air towards the web to dry the web. The drying process is described more closely below.

Downstream of the first dryer unit 9 is the first unit for applying treating agent to the surface of the web 12. The applicator unit comprises a transfer fabric 14, that is pressed against the drying felt 8 by a suction roll 15. The transfer fabric 14 picks the web 12 up from the drying felt 8 and transfers it to the nip of the applicator unit. The application nip is formed by a shoe press 16 and a backing roll 17 forming an extended nip, and a coating transfer belt 18 is arranged to travel through the nip. The coating transfer belt 18 is a smooth belt made of metal, for example steel, or polymer or composite material. The coating transfer belt 18 is arranged to travel guided by guide rolls 13, and, in this position, the coating transfer belt 18 is below the transfer fabric 14. The treating agent is spread on the coating transfer belt 18 by an applicator unit 19. The applicator unit may be a short-dwell applicator, spray applicator unit, a film transfer unit or any other applicator unit capable of spreading an uniform coating layer on the smooth surface of the belt 18. On the path of the transfer fabric 14 is arranged cleaning means 36 for removing moisture, contaminants and material adhered onto the fabric from said fabric.

An applicator unit comprising an extended nip and a transfer belt provides essential benefits when the treatment of the web is performed on the drying section of a paper or board machine. First, the treating agent always includes water, and, on the extended application nip, the web is pressed between a permeable fabric 14 and impermeable belt 18 in a long nip. The long nip removes water efficiently from the web onto the fabric 14. Second, the treating agent is pressed in the nip into the pores of the web, which is particularly beneficial in application of sizing agent and makes it possible to use large amounts of size, which provides a strong web. The long nip also smoothes the surface of the web, whereby the treated web has good smoothness and other properties affecting the printability of the web. The smoothing effect of the extended nip is further intensified by the high water content of the web that makes the web easily deformable. Further, a characteristic feature of a shoe press or extended nip is that it provides good surface properties, but because of a low pressure in the nip, the nip does not decrease the volume of the web whereby the bulk of the web is maintained. This is very important because better bulk provides better stiffness on the same volumetric weight and also the same stiffness can be obtained by using less fiber material which decreases the material consumption and cost of the product.

Downstream of the applicator unit is a second drying unit 20 that is similar to the first drying unit 7–13. The coating transfer belt 18 transfers the web 12 to the second drying felt that in this position is arranged above the path of the web. Downstream of the second drying unit 20 is a second applicator unit 21 which also is in inverted position to the first applicator unit 14–20. After the second applicator unit 21 is a third drying unit 35 whereafter the web is transferred to a roller for further processing.

In the embodiment of the invention shown in FIG. 1, the drying method of the drying unit includes heating and drying of the web by means of impingement drying on the surface of a material, which is permeable and has a sufficient porosity volume. In the drying and coating method, the paper or cardboard web is transferred as closed transfer from the last press nip on a surface of a transfer belt and press felt with help of the transfer suction roll to a transfer felt, and further with another transfer roll into the first impingement drying unit. If the web is transferred from the last press nip on the surface of the upper fabric, it can be transferred from the surface of this upper fabric with the transfer suction roll directly into the first upper impingement drying unit. It is not necessary to have the impingement blow of the first impingement drying unit from upwards. The web can be transferred into the first lower impingement drying phase directly from the lower fabric of the press nip with help of the transfer suction roll. The impingement drying from underneath generates a greater content of dry matter for the lower surface than for the upper surface and the runnability of the following cylinder dryer section with regard to the adhesion on the cylinders is better after the impingement drying.

The drying wire is preferably quite smooth and has a good absorbency. The drying wire is most advantageously cooled before the impingement drying area with a cooling unit and possibly also during the impingement drying by cold air blow boxes to form a temperature gradient on the web. The water and the fibers at the surface on the impingement dried side get warmer when the impingement drying with hot air or with superheated steam is done against the drying wire which most preferably is cooled, and, when the temperature is high enough (over about 65° C.), evaporation of water occurs. A part of the water evaporated from the web is transferred into the cooler drying wire and condenses in it.

The water condensed in the dryer fabric is removed after the impingement drying unit by centrifugal drying, a suction unit and/or a blowing unit, which can act also as a cooling device for the dryer fabric. The dryer fabric is supported along its almost horizontal run, for example, with rolls, which can be non-smooth rolls or Vac-rolls, and also with support of blow suction boxes.

Coating is carried out after the first or the few first impingement drying units. Characteristics for the coating is the closed web transfer into the coating phase from the drying unit with help of the transfer fabric, dosing of the coating agent (e.g., size or pigment coating mix) at the coating unit on the surface of the belt transferring the coating agent and pressing the coating to web surface, most advantageously with extended nip press. The web is transferred after the press nip as a closed transfer on the surface of the belt into the next handling phase (drying or coating). The coating unit can be, e.g., a blade coater, rod coater, roll coater, spraying device or a combination thereof.

Alternatively, both fabrics going through the same coating unit can be belts and the coating is metered on the surface of both of them and/or the intermediate calendering is realized by the double-belted unit. There can be an intermediate drying phase after the first coating phase of the other web side and, after that, the coating of the other side with the same method. There can be one or more impingement drying units after the later coating phase and after that an ordinary cylinder drying unit or the final drying of the web can alternatively be realized with the mentioned impingement drying method.

Figure 2:
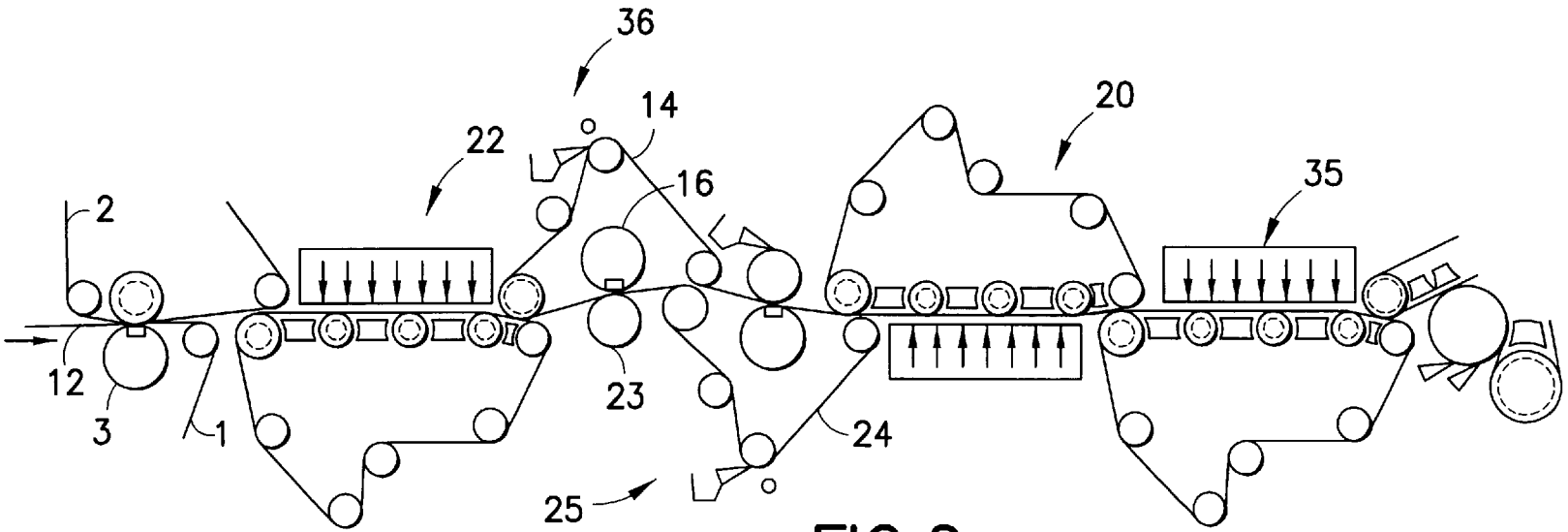
FIG. 2 shows diagrammatically another embodiment of the invention.

Paper or cardboard web is transferred as a closed transfer from the last press nip on the surface of the transfer belt or the press felt and with help of the transfer suction roll onto the transfer fabric and further with help of the other transfer suction roll onto the drying fabric of the first impingement drying unit. Also web transfer without the transfer fabric into the impingement drying is possible, as shown in FIG. 2. The drying method of the drying unit includes heating of the web and drying of the web by means of impingement drying on the surface of material, which is permeable and has a sufficient porosity volume, is preferably quite smooth-surfaced and has a good absorbency. Also two nested fabric loops, fine and rough wires, can be used or can be combined into a single fabric. The drying fabric is most advantageously cooled before the impingement drying with cooling units and possibly also during the impingement drying with cold air blow boxes. Also, an embodiment without cooling is possible. The water and the fibers at the surface on the impingement dried side are first warmed when the impingement drying with hot air or with superheated steam is done against the drying wire which most preferably is cooled, and when the temperature is high enough (over about 65° C.) water evaporation from the web begins to occur effectively. A part of the water evaporated from the web transfers into the cooler drying wire and condenses in it. This drying method ensures an efficient process that saves both energy and machine length. The water condensed in the dryer fabric is removed after the impingement drying unit with centrifugal drying, by doctoring, with a suction unit and/or a blowing unit, which can act also as a cooling device for the dryer fabric.

The dryer fabric is supported along its almost horizontal run, for example, with rolls, which can be non-smooth rolls or Vac-rolls, and also with supports of blow suction boxes. Also impingement drying on the Vac-roll which most preferably has large diameter and is optionally cooled, is an alternative for drying in a planar position. Also the combination of the previous methods is possible. The coating phase is carried out after the first or the few first impingement drying units. Characteristics for the coating is the closed web transfer into the coating phase from the drying unit with help of the transfer fabric, dosing of the coating agent (e.g., size or pigment coating) at the coating unit on the surface of the smooth, impermeable belt and pressing of the coating from the belt onto the web surface, most preferably with extended nip press, so the nip pressure distribution is controllable to optimum within wide ranges. The dosing unit of the coater can be, e.g., a blade coater, rod coater, roll coater, a spraying device (the coating is sprayed onto the belt or directly onto the web possibly intensified by electric field) or any combination thereof. Alternatively, both fabrics going through the same coating unit can be belts and a light coating layer is metered on the surface of them both. Instead of coating, calendering or light weight coating and calendering simultaneously can be made by double-belted unit, as shown in FIG. 2.

After the first, one-sided coating phase, the web is transferred as supported transfer to the impingement drying phase and after that to coating of the other side with the same method. Following the second coating phase there is an impingement drying unit or units and after that may be one or more ordinary cylinder drying units. The final drying of the web can alternatively be realized with the mentioned impingement drying method.

The apparatus shown in FIG. 2 differs from the arrangement of FIG. 1 in few aspects. In this apparatus, the web 12 is transferred directly by the surface of the transfer belt 2 to the first drying stage 22. The dryers are similar to the dryers of the embodiment shown in FIG. 1. After the first drying stage 22 follows treatment of the web in two successive stages. In this embodiment, the coating mixture is spread on the surface of a film transfer roll 23, which operates simultaneously as a backup roll for the shoe press 16. The treating agent remains for a shorter time on a transfer surface than in the embodiment shown in FIG. 1, but the nip is =extended in the same way as in the FIG. 1 embodiment. The advantage of this embodiment is that normal film transfer rolls and applicators can be used for application of the treating agent. The treatment of the opposite side of the web follows immediately without intermediate drying, wherefore the fabric of the second applicator unit has to be replaced by a smooth belt 24 that does not adhere to the surface of the treated web.

The paper web 12 is transferred from the upper transfer belt or felt of the press section directly to the top impingement drying phase or phases 22 as in FIG. 1. The web is adhered from the drying fabric to a smooth belt 14 having proper elastic properties by pressing or with sticking nip, on which belt the coating can also be metered (size/pigment coating) and from which belt the web is transferred to an extended calendering and/or coating nip. Counter roll 23 is preferably a heatable calender roll and a light coating can be metered on its surface before the calendering and/or coating nip. After the first coating phase the web is transferred on a belt 24 which is stickier than the first one to another "counter sided" coating phase and from that on to impingement drying 20, 35 and/or cylinder drying.

Figure 3:
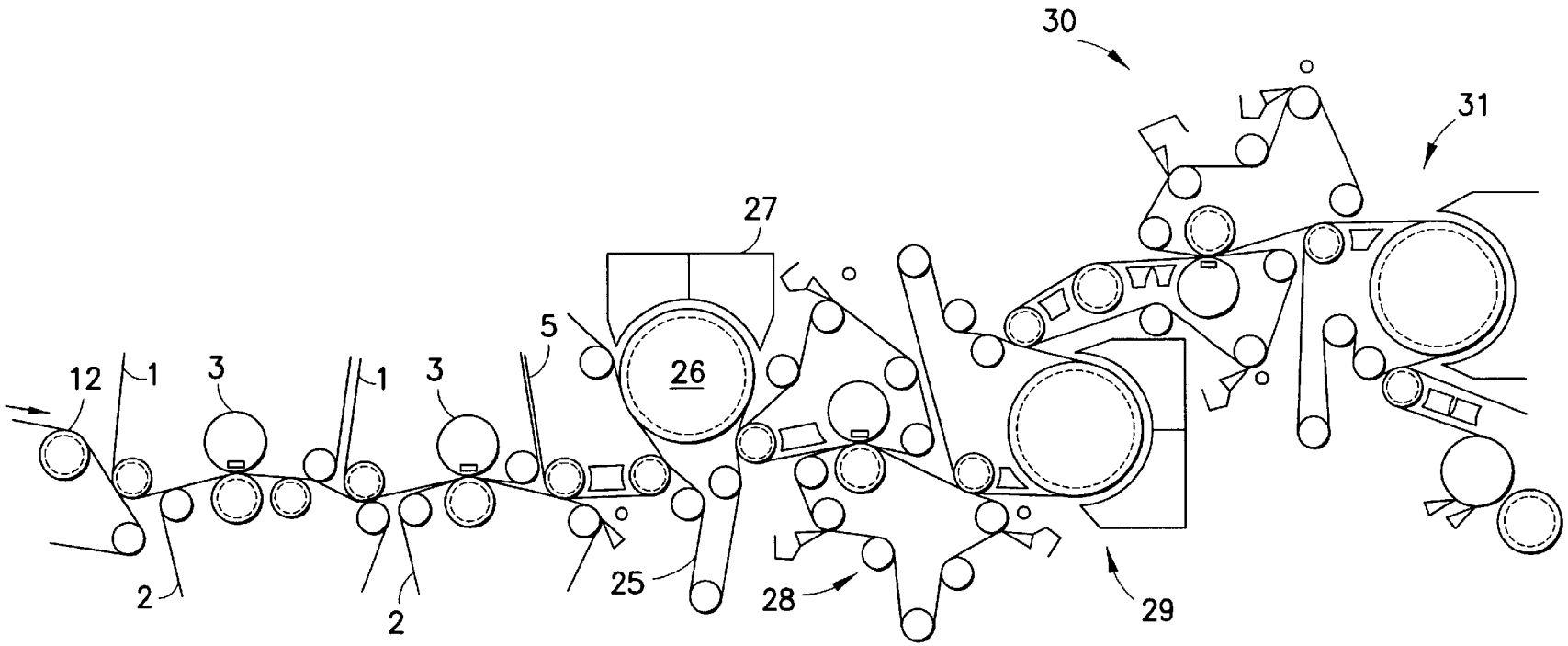
FIG. 3 shows diagrammatically another embodiment of the invention.
Figure 4:
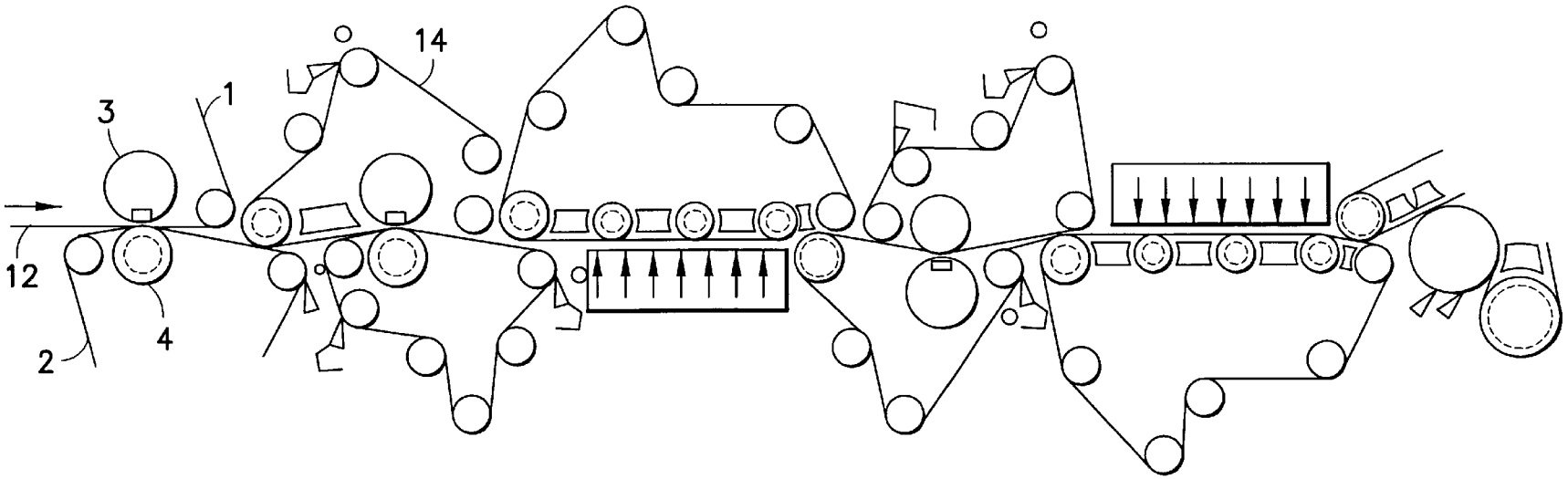
FIG. 4 shows diagrammatically another embodiment of the invention.

In FIG. 3 is shown two last press nips of the press section of a paper or board making machine. From the last press nip, the web 12 is transferred on a transfer felt 5 to a first drying felt 25 that travels around a vacuum drying cylinder 26, which may be cooled. Around the cylinder is arranged impingement dryers 27 that blow hot air or superheated steam on the web 12 and the drying felt 25. Downstream of the vacuum dryer roll is an applicator unit 28 that is similar to the applicator units of the embodiment described in FIG. 1. Downstream is a second vacuum dryer unit 29, second applicator unit 30 and third vacuum dryer unit 31. The embodiment of FIG. 4 is similar to the embodiment of the FIG. 1 except that the web 12 is transferred onto the transfer felt 14 of an applicator unit directly on the transfer belt 2 of the last press nip of the press section.

In all embodiments of the invention the web is continuously supported by a continuos support elements arranged to run in loops. The support elements may be wires, felts, belts or other suitable band-like elements.

Advantages of the drying and coating methods, are:

The paper or board web is transferred as supported transfers with low, optimal tensile differences and strains for the web from wire section to final drying or possibly even to reeling thus enabling a great running speed and high efficiency.

Drying of the paper is made by an efficient energy-saving drying method, which enables on-line coating and calendering phases having supported transfers at every stage and avoiding sticking of the coating to the counter surfaces.

By these methods good, symmetrical and uncurled properties of paper or board are achieved and the properties can be optimal with wide process control value ranges of different drying, coating and/or calendering phases.

Thus, while there have been shown and described and pointed out fundamental novel features of the present invention as applied to a preferred embodiment thereof, it will be understood that various omissions and substitutions and changes in the form and details of the devices illustrated, and in their operation, may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for producing paper or board web, comprising:

leading a paper or board web formed in a press section of a paper or board machine to a drying section continuously supported by a first continuous support member;

receiving the web in the drying section on a second continuous support member;

drying the web in the drying section, wherein the web is partially dried in a portion of the drier section;

leading the partially dried web supported on a continuous support member through an application section;

applying a treating agent to a surface of the partially dried web; and after the treating agent has been applied to the surface of the partially dried web, pressing the treating agent onto the surface of the partially dried web and removing water from the web in an extended nip.

2. The method of claim 1, wherein a treating agent is applied to both sides of the web.

3. The method of claim 2, further comprising drying the web after the treating agent has been applied to a first side of the web and before the treating agent is applied to a second side of the web.

4. The method of claim 2, wherein the treating agent is applied to the web by spreading the treating agent onto a transfer belt running through the extended nip.

5. The method of claim 2, wherein the treating agent is applied to the web by spreading the treating agent onto a transfer roll forming the extended nip.

6. The method of claim 4, wherein a heatable calender roll forms the extended nip.

7. The method of claim 4, wherein the treating agent is applied to the web by spreading the treating agent onto the calender roll.

8. The method of claim 7, wherein a heatable calender roll forms the extended nip.

9. The method of claim 1, wherein the second continuous support member is a drying felt, and further comprising drying the web on the drying felt by blowing a heating agent onto the web and cooling the drying felt so as to form a temperature gradient in the web.

10. The method of claim 9, wherein the web runs substantially linearly during drying and is dried by a linear impingement dryer.

11. The method of claim 9, wherein the web runs over a cooled roll and the web is heated by impingement heaters positioned around the roll.

12. An apparatus for a producing paper or board web, comprising:

a first drying section;

a first continuous support member for leading a paper or board web formed in a press section of a paper or board machine to said first drying section continuously supported by said first continuous support member;

a second continuous support member for receiving the web from the first continuous support member and for transporting the web through said first drying section;

an extended nip comprising a pressing element and a counter roll;

a third continuous support member for leading the web supported on said third continuous support member from the second continuous support member through the extended nip; and a means for applying a treating agent to a side of the web before the web enters said extended nip, wherein said extended nip is positioned in said drying section so that the web is partially dried before the treating agent is applied to the side of the web.

13. The apparatus of claim 12, comprising at least two extended nips.

14. The apparatus of claim 13, further comprising a second drying section positioned along a path of travel of the web between two of said extended nips.

15. The apparatus of claim 13, further comprising a transfer belt arranged to run through at least one of said extended nips and a means for spreading the treating agent on said transfer belt.

16. The apparatus of claim 13, further comprising a transfer roll forming at least one of said extended nips, and further comprising a means for spreading the treating agent on said transfer roll.

17. The apparatus of claim 15, further comprising a heatable calender roll forming at least one of said extended nips.

18. The apparatus of claim 13, further comprising a means for spreading the treating agent on said heatable calender roll.

19. The apparatus of claim 18, further comprising a heatable calender roll forming at least one of said extended nips.

20. The apparatus of claim 12, wherein said second continuous support member comprises a drying felt, and wherein said drying section comprises a drying means for blowing a heating agent onto the web and a cooling means for cooling said drying felt so as to form a temperature gradient in the web.

21. The apparatus of claim 20, wherein said drying means of said drying section comprises a linear impingement dryer and wherein said drying felt guides the web to run substantially linearly through said linear impingement dryer.

22. The apparatus of claim 20, wherein said drying section further comprises a cooled roll over which the web runs and impingement heaters arranged around the cooled roll.

23. A method for producing paper or board web, comprising:

leading a paper or board web formed in a press section of a paper or board machine to a drying section continuously supported by a first continuous support member;

receiving the web in the drying section on a second continuous support member;

leading the web supported on a continuous support member through an application section;

applying a treating agent to both surfaces of the web; and after the treating agent has been applied to each of the surfaces of the web, pressing the treating agent onto the surface of the web in an extended nip comprising a heatable calender roll, wherein the treating agent is applied to at least one surface of the web by spreading the treating agent onto a transfer belt running through the extended nip.

24. A method for producing paper or board web, comprising:

leading a paper or board web formed in a press section of a paper or board machine to a drying section continuously supported by a first continuous support member;

receiving the web in the drying section on a second continuous support member, the second continuous support member comprising a drying felt;

drying the web on the drying felt by blowing a heating agent onto the web;

cooling the drying felt so as to form a temperature gradient in the web;

running the web over a cooled roll heating the web by impingement heaters positioned around the cooled roll;

leading the web supported on a continuous support member through an application section;

applying a treating agent to a surface of the web; and after the treating agent has been applied to the surface of the web, pressing the treating agent onto the surface of the web in an extended nip.

25. An apparatus for a producing paper or board web, comprising:

a first drying section;

a first continuous support member for leading a paper or board web formed in a press section of a paper or board machine to said first drying section continuously supported by said first continuous support member;

a second continuous support member for receiving the web from the first continuous support member and for transporting the web through said first drying section;

at least two extended nips comprising a pressing element and a counter roll, at least one of said extended nips comprising a heatable calender roll;

a third continuous support member for leading the web supported on said third continuous support member from the second continuous support member through the extended nip;

a transfer belt arranged to run through at least one of said extended nips; and a means for spreading the treating agent on said transfer belt before the transfer belt runs through the extended nip, wherein said transfer belt is positioned so that the treating agent is transferred from said transfer belt to a side of the web before the web enters said extended nip.

26. An apparatus for a producing paper or board web, comprising:

a first drying section;

a first continuous support member for leading a paper or board web formed in a press section of a paper or board machine to said first drying section continuously supported by said first continuous support member;

a second continuous support member for receiving the web from the first continuous support member and for transporting the web through said first drying section, said second continuous support member comprises a drying felt;

an extended nip comprising a pressing element and a counter roll;

a third continuous support member for leading the web supported on said third continuous support member from the second continuous support member through the extended nip; and a means for applying a treating agent to a side of the web before the web enters said extended nip, wherein said drying section comprises:

a drying means for blowing a heating agent onto the web;

a cooling means for cooling said drying felt so as to form a temperature gradient in the web;

a cooled roll over which the web runs; and impingement heaters arranged around the cooled roll.

* * * * *